US006233909B1

(12) United States Patent
Onishi

(10) Patent No.: US 6,233,909 B1
(45) Date of Patent: May 22, 2001

(54) METHOD OF TRANSFERRING A CASE AND APPARATUS FOR TRANSFERRING SAME

(75) Inventor: Toshiyuki Onishi, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/519,406

(22) Filed: Mar. 3, 2000

(30) Foreign Application Priority Data

Oct. 20, 1999 (JP) ..... 11-297910

(51) Int. Cl.[7] ..... B65B 1/04

(52) U.S. Cl. ..... 53/473; 53/474; 53/238; 53/244

(58) Field of Search ..... 53/157, 474, 473, 53/238, 244, 250

(56) References Cited

U.S. PATENT DOCUMENTS 4,881,356 * 11/1989 Beezer et al. ..... 53/238
5,207,050 * 5/1993 Fulkerson et al. ..... 53/474
5,285,620 * 2/1994 Kaye et al. .
5,816,028 * 10/1998 Zaniboni .

* cited by examiner

*Primary Examiner*—Eugene Kim
(74) *Attorney, Agent, or Firm*—W.F. Fasse; W.G. Fasse

(57) ABSTRACT

Oppositely disposed case introduction and ejection stations (A, C), and oppositely disposed first and second insertion space forming stations (B, B') are spaced equally along the circumference around a turret (T). A developed case (10), prior to inserting a title sheet (P) therein, is introduced into the case introduction station (A). A developed case (10), after inserting a title sheet (P) therein, is ejected into the case ejection station (C). At the first and second insertion space forming stations, (B, B'), a case body (11) is deflected into a flat, reversed V-shape to form a title sheet insertion space (S) between the case body (11) and a transparent cover (12). The turret (T) is rotatable by 90 degrees in forward and reverse directions and has first to fourth suction heads (71 to 74) corresponding to each of the stations. At each of the first and second insertion space forming stations (B, B'), there is also provided a mounting stand (79) on which a case (10) having the title sheet insertion space (S) formed therein is mounted. With each successive 90° rotation of the turret, a successive case without a title sheet is moved into one of the title sheet insertion space forming stations, and a case with a title sheet inserted therein is transferred to the ejection station.

11 Claims, 10 Drawing Sheets

(a)

(a) ~ (b)

(b)

(b)

(b)~ (c)

(c)

(c)

(c) ~ (d)

(d)

(d)

(d) ~ (e)

(e)

(c)

(c) ~ (d)

(d)

(d)

(d)~(e)

(e)

(d)

(d) ~ (e)

(e)

(e)

METHOD OF TRANSFERRING A CASE AND APPARATUS FOR TRANSFERRING SAME

FIELD OF THE INVENTION

The present invention relates to the field of automated packaging, and more particularly, to a method and an apparatus for transferring an optical disk case during inserting a title sheet into the case.

BACKGROUND INFORMATION

An optical disk case generally has an openable plastic case body. An optical disk is loaded into one side of the case body and a description sheet is inserted into the other side of the case body. A transparent cover for inserting a title sheet is provided on the front side of the case body. A title sheet is a flexible sheet on which a title of the optical disk and other visual information are printed.

Conventionally, as there were no automated packaging machines to load an optical disk and insert a title sheet into a case, these loading and inserting operations were done by hand, which was very troublesome.

The solution to this problem is identified in Onishi, Japanese patent application No. 11-217277. As shown in Onishi, an automated optical disk loading machine is provided where loading of an optical disk and insertion of a title sheet are automatically conducted.

In operation, as a case conveyor carries a plurality of cases, an optical disk loading device loads an optical disk into a case, a title sheet inserting device inserts a title sheet into the transparent cover of the case, and a description sheet inserting device inserts a description sheet into a claw portion of the case.

In inserting a title sheet into the case, as a suction pad holding a developed case moves downward, the case body is bent into a flat, reversed V-shape. Thus, the transparent cover is deformed into a general V-shape by its own weight, which causes a title sheet insertion space to be formed in the case. In this condition, the title sheet deformed into a corrugated form by a corrugation forming device is inserted into the title sheet insertion space of the case.

However, in the above machine, while the title sheet is inserted into the title sheet insertion space of the case, the suction pad is in the waiting condition of still holding the case, which results in a decrease in the process rate.

The main object of the present invention is to improve the process rate during insertion of a title sheet.

SUMMARY OF THE INVENTION

The present invention is directed to a method and an apparatus for transferring an optical disk case during insertion of a title sheet into the case.

The method of transferring a case includes the steps comprising:

(i) holding a first developed case, which is introduced into a case introduction station, by a first suction head of a turret, rotating the turret 90 degrees in a first or forward direction to transfer the first case to a first insertion space forming station, deflecting the case body to form a title sheet insertion space between the case body and the transparent cover, of the first case and placing the first case at the first insertion space forming station by releasing the first case from the first suction head, (ii) during the operation of title sheet insertion into the first case placed at the first insertion space forming station, holding a second developed case, which is then introduced into the case introduction station, by a second suction head of the turret, rotating the turret 90 degrees in a second or reverse direction opposite the first direction to transfer the second case to the second insertion space forming station which is positioned opposite the first insertion space forming station, deflecting the case body to form a title sheet insertion space between the case body and the transparent cover of the second case, and placing the second case at the second insertion space forming station by releasing the second case from the second suction head, (iii) after completion of the title sheet insertion operation at the first insertion space forming station, holding the first case with the title sheet inserted thereinto by a fourth suction head placed at the first insertion space forming station, holding a third developed case, which is then introduced into the case introduction station, by the first suction head, rotating the turret 90 degrees in the first or forward direction to transfer the first case held by the fourth suction head to a case ejection station located opposite the case introduction station, and to transfer the case held by the first suction head to the first insertion space forming station, placing the first and third cases at the case ejection station and the first insertion space forming station by releasing the first and third cases from the fourth and first suction heads, respectively; and (iv) after completion of the title sheet insertion operation at the second insertion space forming station, holding the second case with the title sheet inserted thereinto by a third suction head placed at the second insertion space forming station, holding a fourth developed case, which is then introduced into the case introduction station, by the second suction head, rotating the turret 90 degrees in the second reverse direction to transfer the second case held by the third suction head to the case ejection station, and to transfer the fourth case held by the second suction head to the second space forming station, placing the second and fourth cases at the case ejection station and the second insertion space forming station by releasing the second and fourth cases from the third and second suction heads, respectively.

Preferably, each suction head is comprised of a pair of suction pads corresponding respectively to each face of the case body. During transfer of each suction pad from the case introduction station to the first or second insertion space forming station, each suction pad moves downward to deflect the case body into a flat, reversed V-shape. Thus, the transparent cover deforms into a general V-shape via its own weight and the title sheet insertion space is formed between the case body and transparent cover.

The apparatus for transferring a case during insertion of a title sheet into the case comprises a case introduction station where a developed case is introduced before inserting the title sheet, and a case ejection station, disposed opposite to the case introduction station, where the developed case is ejected after inserting the title sheet. Also, the apparatus comprises first and second insertion space forming stations where the case deflects to form a title sheet insertion space between the case body and the transparent cover. The first and second insertion space forming stations are located opposite each other and spaced equally along the circumference. The apparatus further comprises a turret rotatable 90 degrees in the forward and reverse directions, which has first to fourth suction heads corresponding to each of the above-mentioned stations. The apparatus still further comprises, at the first and second insertion space forming stations, a mounting stand for the placement of a case formed with the title sheet insertion space by deflection of the case body.

Preferably, each suction head is comprised of a pair of downward translatable suction pads corresponding respectively to each face of the case body.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
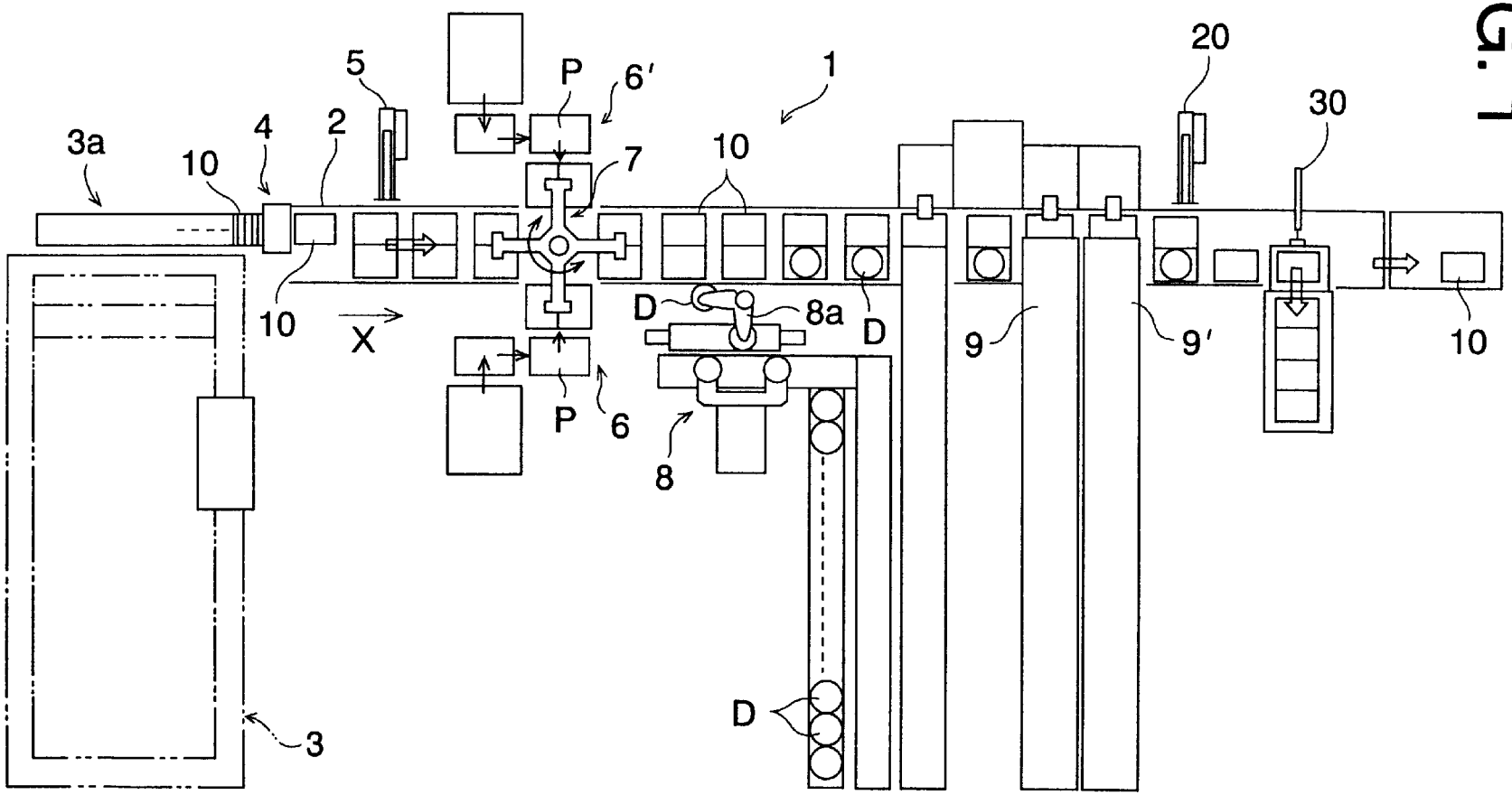
FIG. 1 is a top plan view of an optical disk loading machine employing a method and apparatus for transferring a case according to one embodiment of the present invention.

Referring now to the drawings, FIG. 1 illustrates an optical disk loading machine. As shown in FIG. 1, the machine 1 includes a case conveyor 2 to carry a case 10 in the direction of an arrow X, a case storage station 3 provided at the upstream end in the carrying direction of the conveyor 2, a case supplying device 4 to supply a case 10, which is unloaded from the station 3 and placed on the slope 3*a,* to the case conveyor 2, a case opening device 5 to open a closed case 10, title sheet insertion devices 6 and 6' to insert a title sheet P into the transparent cover of the case 10, and a case transferring device 7 to transfer a case 10 during insertion of a title sheet. The machine further includes an optical disk loading device 8 to load an optical disk D into a loading aperture of the case 10, description sheet inserting devices 9 and 9' to insert a description sheet into a case 10, a case closing device 20 to close a developed case 10, and a pusher 30 to sort a case 10.

Figure 2:
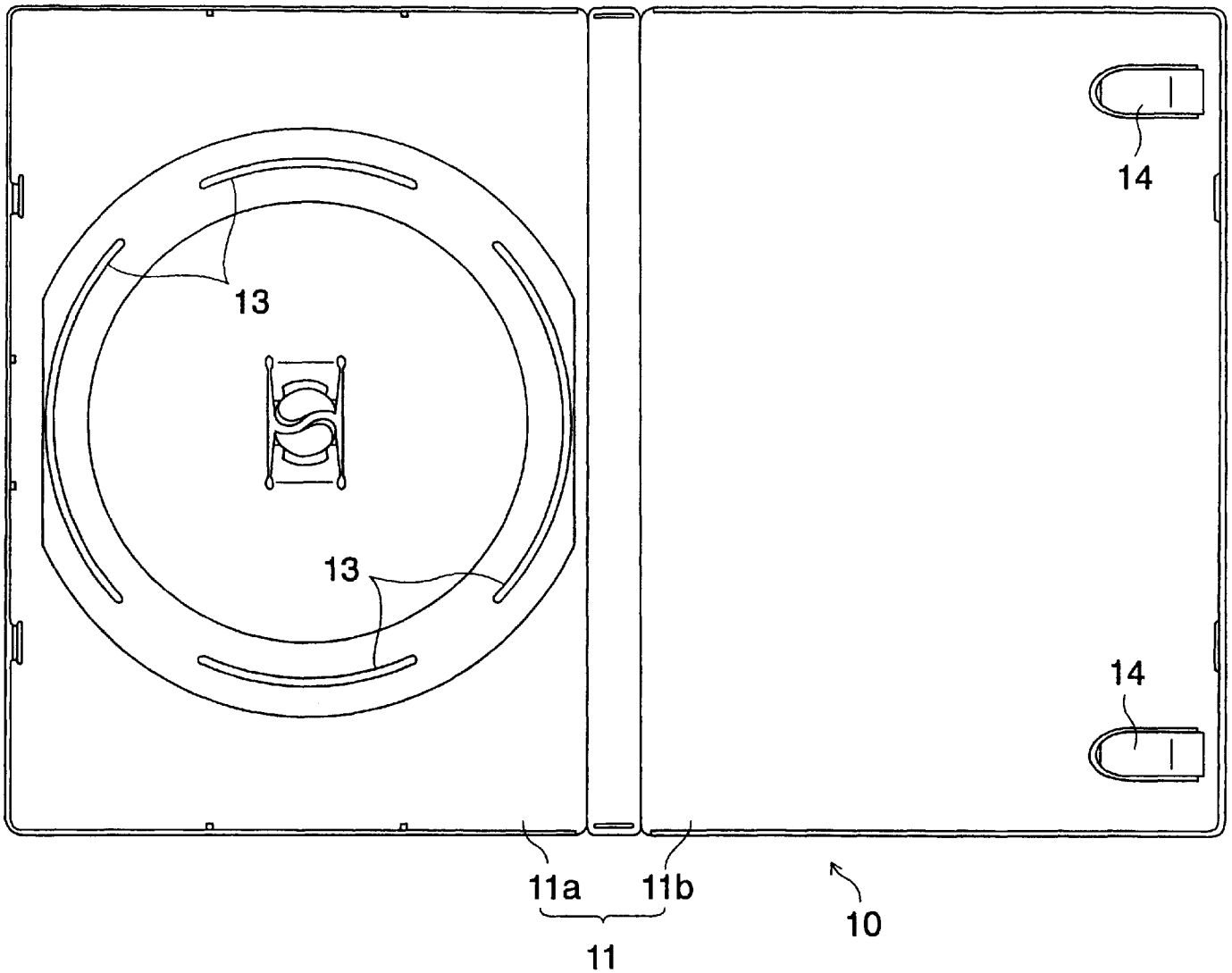
FIG. 2 is a top plan view of a case in the developed condition.
Figure 3:
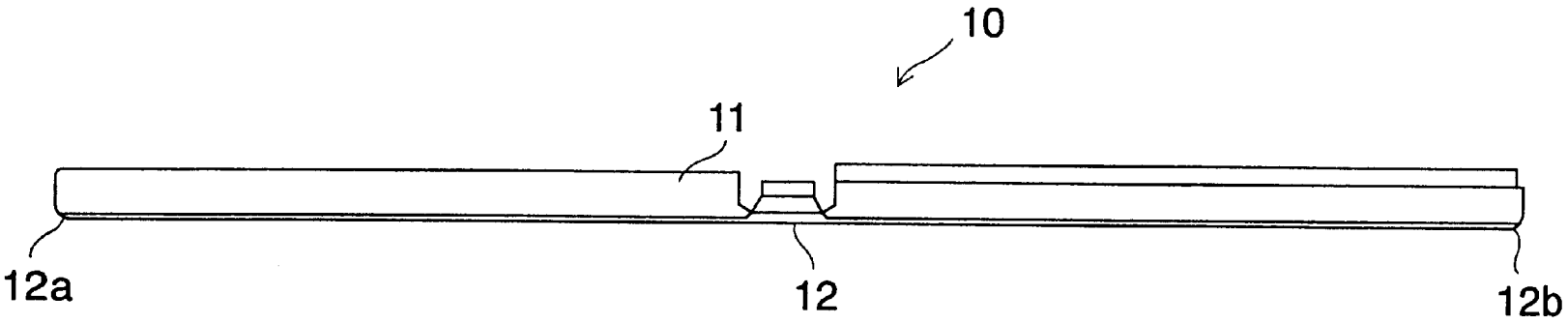
FIG. 3 is a side view of a case in the developed condition.

As shown in FIGS. 2 and 3, a case 10 has a foldable or openable, box-shaped case body 11 and a transparent cover 12 provided on the front side of the case body 11. Both ends 12*a* and 12*b* of the transparent cover 12 are heat-sealed to the end portions of the front side of the case body 11.

On one side 11*a* of the case body 11 is formed a plurality of ridge portions 13 extending circumferentially. These ridge portions 13 form a loading hole for an optical disk (not shown). On the other side 11*b* of the case body 11 are provided a pair of holding claws 14 to hold a description sheet of the optical disk.

The title sheet inserting devices 6 and 6', shown in FIG. 1, are disposed opposite to each other on both sides of the case conveyor 2 to insert a title sheet P into each case 10 on both sides of the conveyor 2. Each of the title sheet inserting devices 6, 6' is comprised of a cope and drag to deform the title sheet P into a corrugated form. The cope and drag have corrugated contact faces and are provided approachably and retreatably with each other, as shown in Onishi, Japanese patent application No. 11-217277, which is incorporated herein by reference. The optical disk loading device 8 includes a rotatable loading head 8*a* having an L-shape. The description sheet inserting devices 9 and 9' are comprised of cylinders and suction portions to attach a description sheet.

Figure 4:
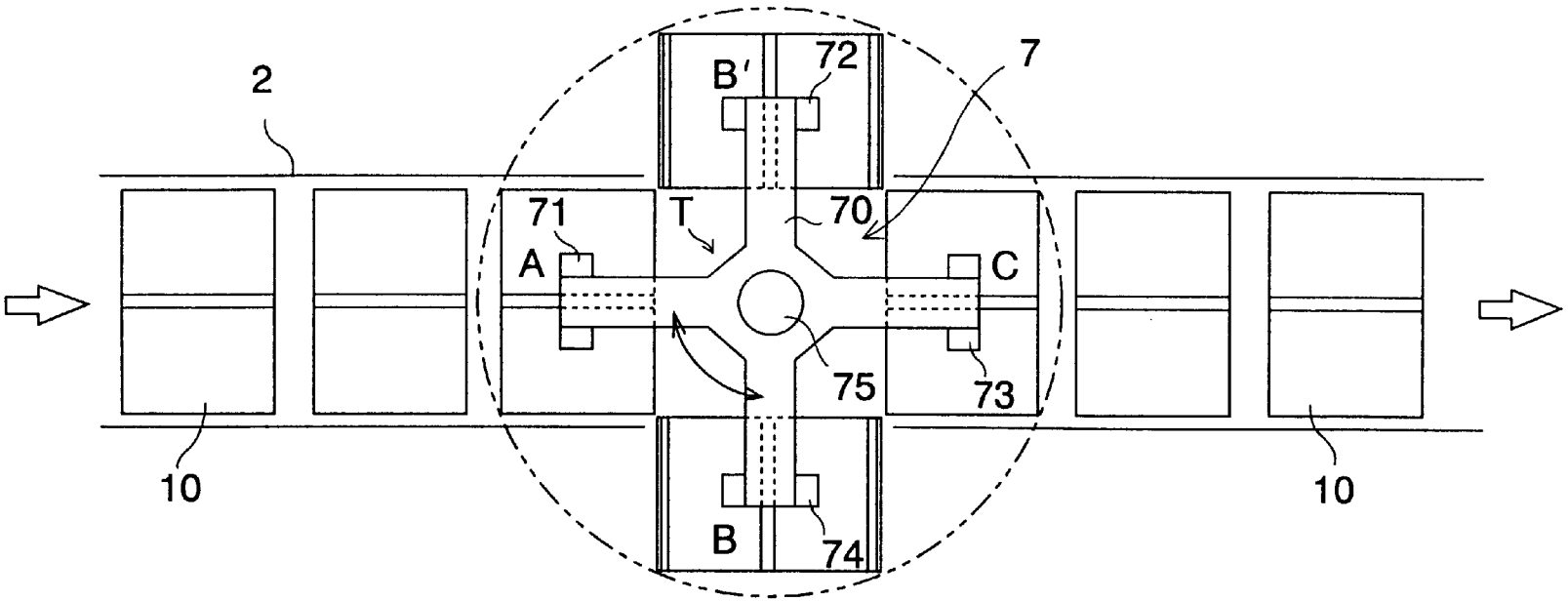
FIG. 4 is a top plan view of a turret of a case transferring apparatus on an enlarged scale.

As shown in FIG. 4, the case transferring device 7 includes a turret T having four arms 70, which are disposed 90 degrees apart from each other and extend radially. The turret T is rotatable in the forward and reverse directions around the rotation shaft 75. Suction pads 71, 72, 73, and 74 are provided at each distal end of the arms 70 to hold a case 10 and are placed on the same circumference around the rotation shaft 75.

In FIG. 4, there are provided on the case conveyor 2 a case introduction station A where a developed case 10 before insertion of a title sheet is introduced, and a case ejection station C, disposed oppositely to the station A, where a developed case 10 after insertion of a title sheet is ejected. First and second insertion space forming stations B and B' are located opposite each other on the outside of the case conveyor 2. These stations A, B, B', and C are spaced equally on the circumference around the turret T.

Figure 5:
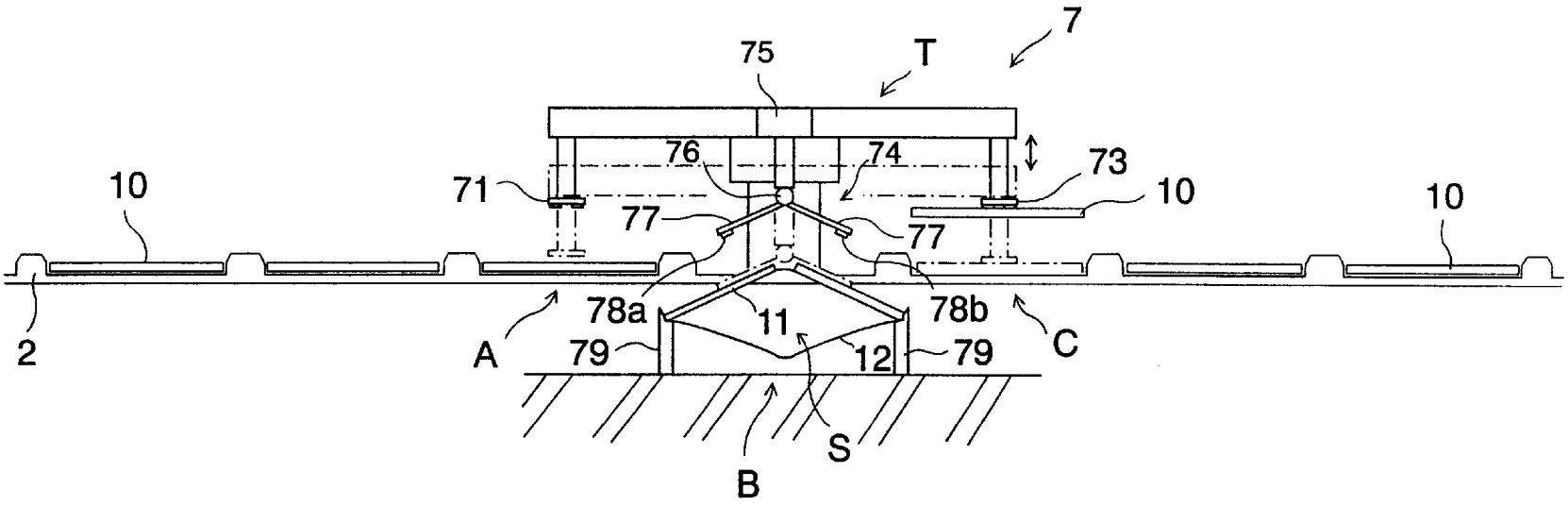
FIG. 5 is a side view of a turret of FIG. 4.

Each of the suction pads 71–74 of the turret T, shown in FIG. 5, is formed of a pair of arm members 77 rotatable around the pivot 76 in the vertical direction. At the distal ends of the arm members 77 are provided two pairs of suction pads 78*a* and 78*b*. The suction pads 78*a,* 78*b* correspond to each face 11*a,* 11*b* of the case body 11, respectively. Also, a mounting stand 79 is provided on the first insertion space forming station B, on which to place a case 10 formed with a title sheet insertion space S between the case body 11 and transparent cover 12. The mounting stand 79 supports the two ends of the case 10. On the second insertion space forming station B' as well, a mounting stand (not shown) is provided.

Next, a case transferring method carried out by the device 7 will be described hereinafter. The suction heads 71–74 in FIG. 4 correspond to the suction heads ①, ②, ③, and ④ in FIGS. 6A to 6I, respectively. In the successive subfigures of FIGS. 7–10, reference numerals ①, ②, ③, and ④ correspond to the suction heads ①, ②, ③, and ④ in the subfigures of FIG. 6, respectively, and reference symbols (a), (b), (c), (d), and (e) in the subfigures of FIGS. 7–10 correspond to the successive steps of FIG. 6A, FIG. 6B, FIG. 6C, FIG. 6D, and FIG. 6E, respectively. Namely, the subfigures FIGS. 7–10 illustrate the movements of the suction heads ①, ②, ④, and ③, respectively. In the following descriptions, reference numerals in parentheses indicate the corresponding numerals in the several subfigures of FIG. 6.

Figure 6A:
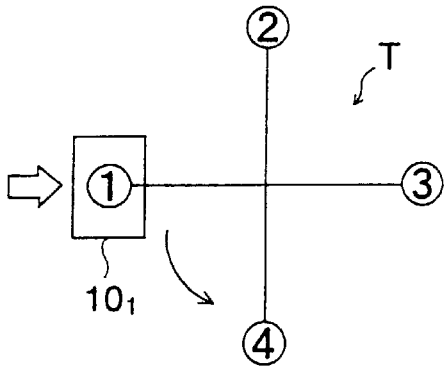
FIGS. 6A to 6E are schematic diagrams illustrating successive steps of a case transferring method of the present invention.
Figure 6B:
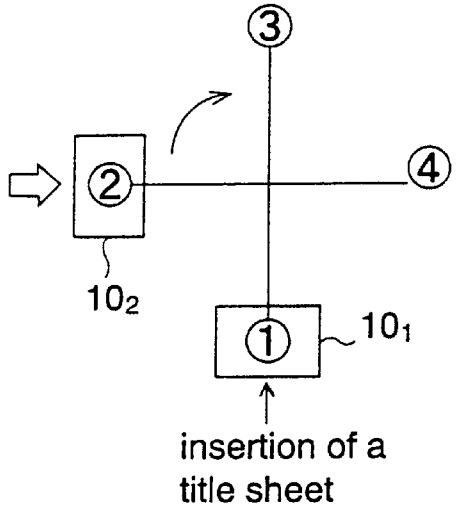
Figure 6C:
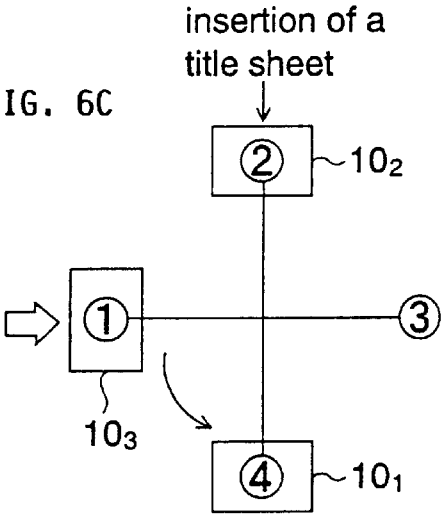

A first developed case 10 ($\mathbf{10}_1$) introduced into the case introduction station A is attached by the suction head 71 (①) (see FIG. 6A). At this time, shown in FIG. 7A, the arm member 77 of the suction head 71 (①) is open to hold the case 10 ($\mathbf{10}_1$) by the suction pads 78*a,* 78*b*. After holding the case 10 ($\mathbf{10}_1$), the suction head 71 (①) moves upward.

Then, the turret T rotates 90 degrees in the counterclockwise direction (or forward direction) to transfer the first case 10 ($\mathbf{10}_1$) held by the suction head 71 (①) to the first insertion space forming station B (see FIG. 6 B). During this transfer, as shown in FIGS. 7D, 7E and 7F, the arm member 77 of the suction head 71 (①) moves downward along with the suction pads 78*a,* 78*b*. In this way, the case body 11 deflects into a flat, reversed V-shape to deform the transparent cover 12 into a general V-shape due to its own weight. Thus, a title sheet insertion space S is formed in the case 10 ($10_1$). The case 10 ($10_1$) formed with the insertion space S is placed on the mounting stand 79 disposed at the first insertion space forming station B. After placement of the case 10 ($10_1$), the suction head 71 (①) releases the case 10 ($10_1$) and retreats upward as shown in FIG. 7G.

The title sheet inserting device 6 inserts a title sheet P into the first case 10 ($10_1$) placed at the first insertion space forming station B. The next or second case 10 ($10_2$), which has been introduced into the case introduction station A during the above-mentioned operation of title sheet insertion, is attached by the suction head 72 (②) placed at the case introduction station A. Then, the turret T rotates 90 degrees in the clockwise direction (or reverse direction). Thus, the second case 10 ($10_2$) attached by the suction head 72 (②) is transferred to the second insertion space forming station B' (see FIG. 6C).

Figure 8A:
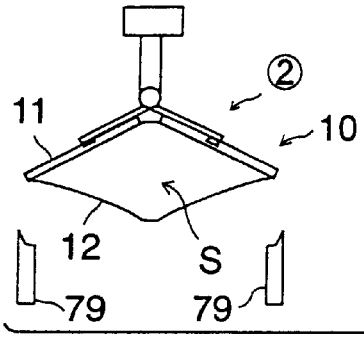
FIGS. 8A to 8I are schematic diagrams showing successive steps of the movement of a suction head ② of a turret.
Figure 8B:
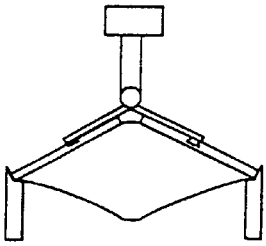
Figure 8C:
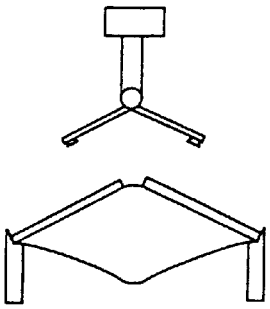
Figure 8D:
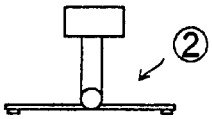
Figure 8E:
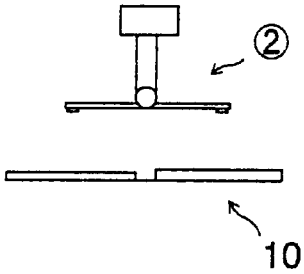
Figure 8F:
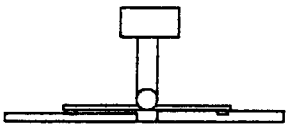
Figure 8G:
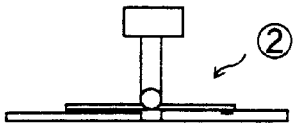
Figure 8H:
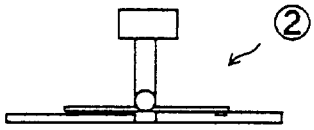
Figure 8I:
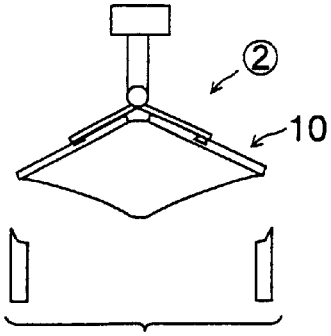
Figure 9A:
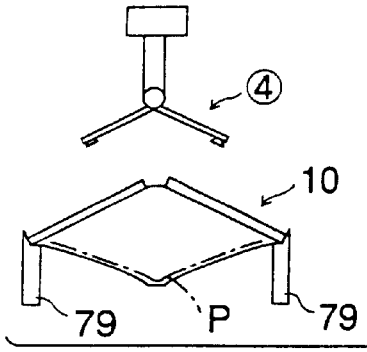
FIGS. 9A to 9I are schematic diagrams showing successive steps of the movement of a suction head ④ of a turret.
Figure 9B:
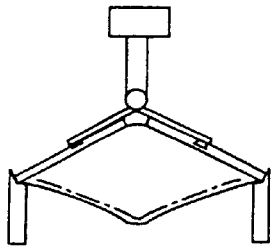
Figure 9C:
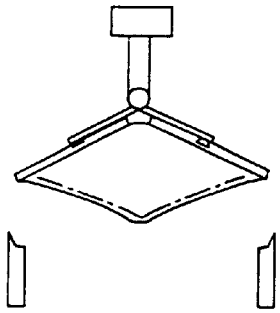
Figure 9D:
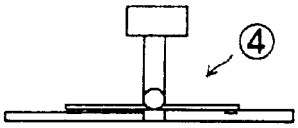
Figure 9E:
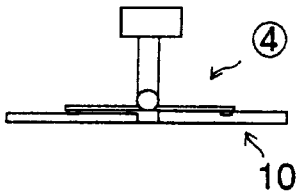
Figure 9F:
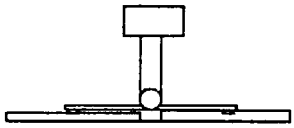
Figure 9G:
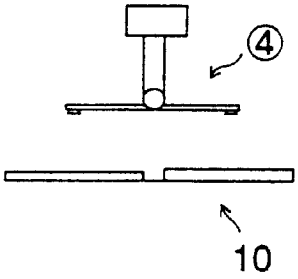
Figure 9H:
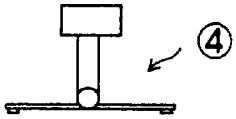
Figure 9I:
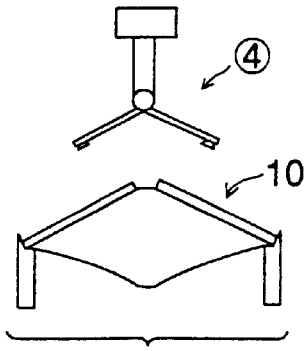

During this case transfer as well, as shown in FIGS. 8A, 8B and 8C, the case body 11 deforms into a flat, reversed V-shape to form a title sheet insertion space S in the second case 10 ($10_2$). The second case 10 ($10_2$) formed with the insertion space S is placed on the mounting stand 79 disposed at the second insertion space forming station B'. After placement of the second case 10 ($10_2$), the suction head 72 (②) releases the second case 10 ($10_2$) and withdraws upward as shown in FIG. 8C.

Then, after completion of title sheet insertion into the first case 10 ($10_1$) at the first insertion space forming station B, while the title sheet inserting device 6' inserts a title sheet P into the second case 10 ($10_2$) placed at the second insertion space forming station B', the first case 10 ($10_1$) having a title sheet P inserted thereinto is attached by the suction head 74 (④) placed at the first insertion space forming station B as shown in FIG. 6C and FIGS. 9A, 9B and 9C. At this time, the next or third case 10 ($10_3$), which has been introduced at the case introduction station A, is attached by the suction head 71 (①). In this case, when the suction head 74 (④) travels downward and upward (see the solid and dashed lines of FIG. 5), the suction head 71 (①) moves downward and upward at the same time, which causes each process to be proceeded effectively.

Figure 6D:
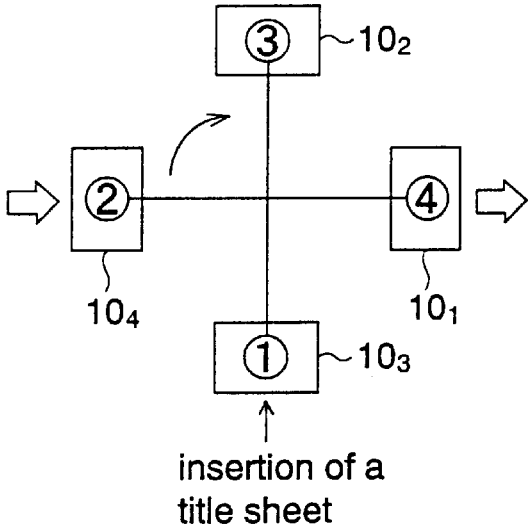
Figure 7A:
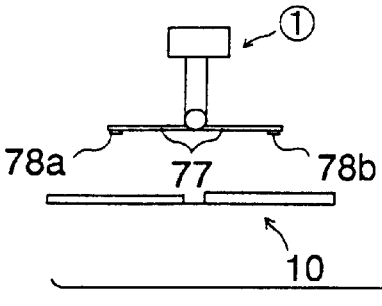
FIGS. 7A to 7I are schematic diagrams showing successive steps of the movement of a suction head ① of a turret.
Figure 7B:
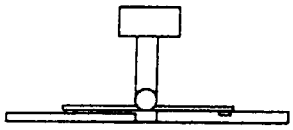
Figure 7C:
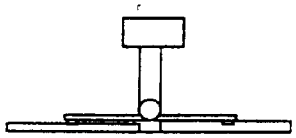
Figure 7D:
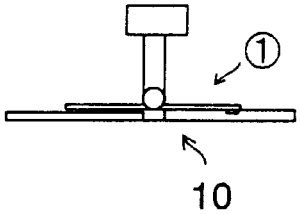
Figure 7E:
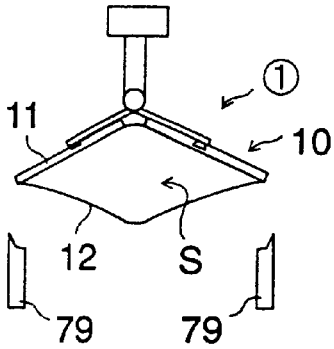
Figure 7F:
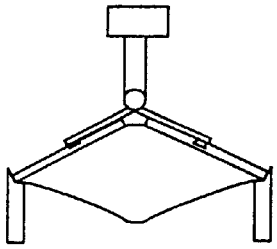
Figure 7G:
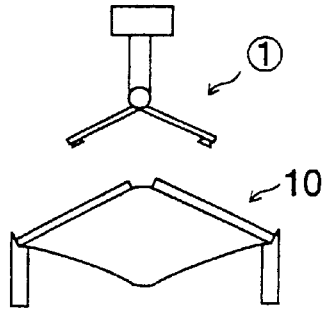
Figure 7H:
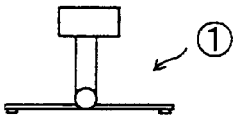
Figure 7I:
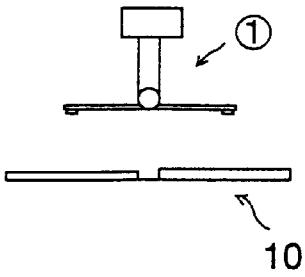

Then, 90 degrees of rotation of the turret T in the counterclockwise direction causes the transfer of the first case 10 ($10_1$) attached by the suction head 74 (④) to the case ejection station C and the transfer of the third case 10 ($10_3$) attached by the suction head 71 (①) to the first insertion space forming station B (see FIG. 6D). Thereafter, the suction head 71 (①) releases the third case 10 ($10_3$) and places it at the first insertion space forming station B. Also, the suction head 74 (④) releases the first case 10 ($10_1$) and places it at the case ejection station C (see FIGS. 9E and 9F).

In this case as well, the suction head 74 (④) moves downward and upward at the same time of the downward and upward movement of the suction head 71 (①) (see the solid and dashed lines of FIG. 5). Thereby, each process can be proceeded effectively. The first case 10 ($10_1$) placed at the case ejection station C is carried by the case conveyor 2.

Figure 10A:
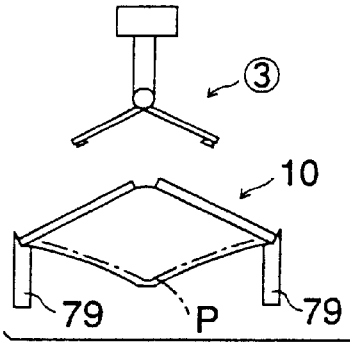
FIGS. 10A to 10G are schematic diagrams showing successive steps of the movement of a suction head ③ of a turret.
Figure 10B:
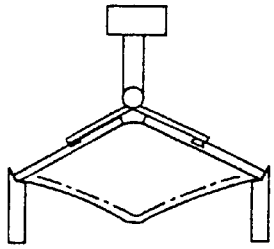
Figure 10C:
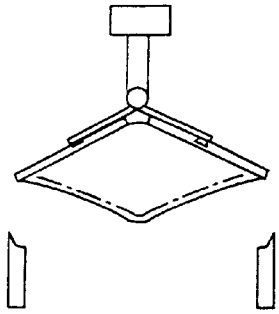
Figure 10D:
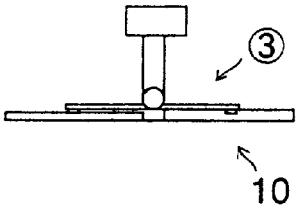
Figure 10E:
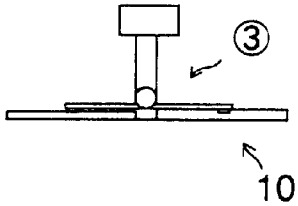
Figure 10F:
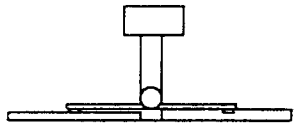
Figure 10G:
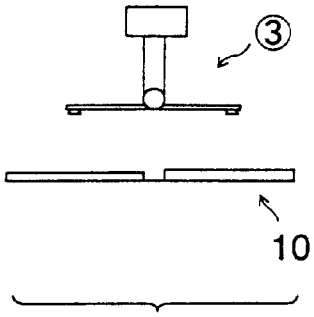

Then, after completion of title sheet insertion into the second case 10 ($10_2$) at the second insertion space forming station B', while the title sheet inserting device 6 inserts a title sheet P into the third case 10 ($10_3$) placed at the first insertion space forming station B, the second case 10 ($10_2$) having a title sheet P inserted thereinto is attached by the suction head 73 (③) placed at the second insertion space forming station B' (see FIGS. 10A, 10B and 10C). At this time, the next or fourth case 10 ($10_4$), which has been introduced at the case introduction station A, is attached by the suction head 72 (②) (see FIGS. 8E and 8F).

Figure 6E:
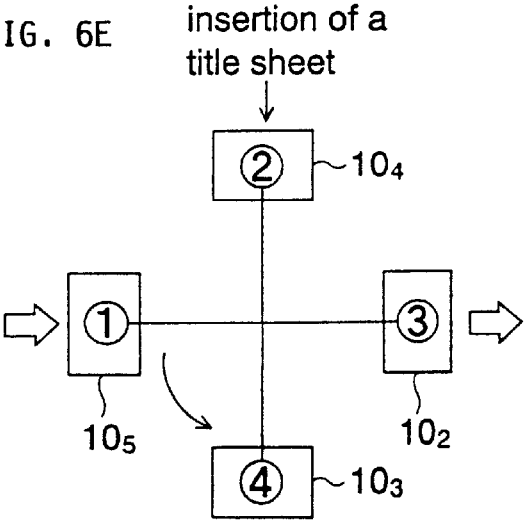

Then, 90 degrees of rotation of the turret T in the clockwise direction causes the transfer of the second case 10 ($10_2$) attached by the suction head 73 (③) to the case ejection station C and the transfer of the fourth case 10 ($10_4$) attached by the suction head 72 (②) to the second insertion space forming station B' (see FIG. 6E). Thereafter, the suction heads 72 (②), 73 (③) release and place the fourth and second cases 10 ($10_4$), 10 ($10_2$), respectively, at the second insertion space forming station B' and case ejection station C.

In such a manner, each time a case 10 is introduced into the case introduction station A, the operations shown in FIGS. 6D and 6E will be repeated.

According to the above-mentioned, preferred embodiment of the present invention, the insertion space forming stations B, B' are provided at the two positions located opposite each other, and 90 degrees of alternate rotation of the turret T in the clockwise and counterclockwise direction causes the transfer of a case to the first and second insertion space forming stations B, B', respectively. Thereby, the necessity is eliminated for placing the suction head in the waiting condition at the time of title sheet insertion, which can improve the process rate of title sheet insertion.

Also, in the embodiment of the present invention, when a case is transferred to the insertion space forming stations B, B' from the case introduction station A, a suction head comprising a pair of suction pads moves diagonally downward and the case body deflects into a flat, reversed V-shape to deform the transparent cover in a general V-shape due to its own weight. Thus, a title sheet insertion space S can be easily formed in the case, and forming an insertion space S can be realized by a simpler mechanism.

Those skilled in the art to which the invention pertains may make modifications and other embodiments employing the principles of this invention without departing from its spirit or essential characteristics particularly upon considering the forgoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A method of transferring media disk storage cases and inserting respective information sheets into said cases, using an apparatus including:

a rotatable turret that is rotatable about an axis;

respective first, second, third and fourth case holding heads mounted on said turret at respective uniformly circumferentially offset positions about said axis;

a case introduction station, a first sheet insertion station, a case ejection station, and a second sheet insertion station, which are respectively arranged adjacent to said turret at respective uniformly circumferentially offset locations about said axis, wherein said case ejection station is opposite said case introduction station, and said first sheet insertion station is opposite said second sheet insertion station;

said method comprising the following steps:

a) picking up a first media disk storage case from said case introduction station with said first case holding head, rotating said turret 90 degrees in a first rotation direction to transfer said first case from said case introduction station to said first insertion station, and then releasing said first case from said first case holding head at said first insertion station;

b) inserting a first information sheet into said first case at said first insertion station;

c) picking up a second media disk storage case from said case introduction station with said second case holding head, rotating said turret 90 degrees in a second rotation direction opposite said first rotation direction to transfer said second case from said case introduction station to said second insertion station and to move said fourth case holding head to said first insertion station and said first case holding head to said case introduction station, and then releasing said second case from said second case holding head at said second insertion station;

d) inserting a second information sheet into said second case at said second insertion station;

e) after completing said steps b) and c), picking up said first case from said first insertion station with said fourth case holding head, picking up a third media disk storage case from said case introduction station with said first case holding head, rotating said turret 90 degrees in said first rotation direction to transfer said first case from said first insertion station to said case ejection station and said third case from said case introduction station to said first insertion station, and to move said third case holding head to said second insertion station and said second case holding head to said case introduction station, and then releasing said first case from said fourth case holding head at said case ejection station and releasing said third case from said first case holding head at said first insertion station;

f) inserting a third information sheet into said third case at said first insertion station; and g) after completing said steps d) and e), picking up said second case from said second insertion station with said third case holding head, picking up a fourth media disk storage case from said case introduction station with said second case holding head, rotating said turret 90 degrees in said second rotation direction to transfer said second case from said second insertion station to said case ejection station and said fourth case from said case introduction station to said second insertion station, and then releasing said second case from said third case holding head at said case ejection station and releasing said fourth case from said second case holding head at said second insertion station.

2. The method according to claim 1, wherein each one of said cases respectively comprises an openable case body and a transparent cover attached to said case body, and wherein said steps of releasing a respective one of said cases at a respective one of said insertion stations and inserting a respective information sheet into said respective case comprises deflecting said case body of said respective case into such a configuration so as to form a sheet insertion space between said transparent cover and said case body, and then inserting a respective information sheet into said sheet insertion space.

3. The method according to claim 2, wherein:

each one of said case holding heads comprises a respective suction head which respectively includes a pair of suction pads;

each said step of picking up a respective one of said cases with a respective one of said case holding heads comprises applying suction to two faces of said respective case with said respective pair of suction pads;

each said step of deflecting said case body comprises moving said suction pads downward relatively in an inverted V-shape so as to deflect said case body into a corresponding inverted V-shape and allowing said transparent cover to hang downwardly from said case body due to the weight of said cover so as to form said insertion space.

4. The method according to claim 1, wherein each one of said case holding heads comprises a respective suction head, and each said step of picking up a respective one of said cases with a respective one of said case holding heads comprises applying suction to said respective case with said respective suction head of said respective case holding head.

5. The method according to claim 4, wherein each said step of picking up a respective one of said cases further comprises moving up-and-down said turret with said suction heads mounted thereon, together in common.

6. The method according to claim 1, wherein said steps of rotating said turret consist of rotating said turret cyclically back-and-forth by 90° without ever rotating more than 90°.

7. An apparatus for transferring media disk storage cases for insertion of respective information sheets into said cases, said apparatus comprising:

a rotatable turret that is rotatable about an axis in opposite first and second rotation directions;

respective first, second, third and fourth case holding heads mounted on said turret at respective uniformly circumferentially offset positions about said axis;

a case introduction station adapted to supply successive media disk storage cases, a first sheet insertion station at which an information sheet can be inserted into a respective one of said cases, a case ejection station adapted to eject successive ones of said cases, and a second sheet insertion station at which an information sheet can be inserted into a respective one of said cases, wherein said stations are respectively arranged adjacent to said turret at respective uniformly circumferentially offset locations about said axis, wherein said case ejection station is opposite said case introduction station, and wherein said first sheet insertion station is opposite said second sheet insertion station; and first and second mounting stands respectively arranged at said first and second insertion stations and adapted to receive a respective one of said cases supported thereon.

8. The apparatus according to claim 7, wherein said case holding heads respectively comprise suction heads.

9. The apparatus according to claim 8, wherein each one of said suction heads respectively comprises a pair of suction pads that are movable in an upward and downward direction so as to suction engage respective first and second faces of a respective one of said cases.

10. The apparatus according to claim 7, wherein said turret is cyclically rotatable back-and-forth by 90° about said axis.

11. The apparatus according to claim 7, wherein said turret is movable upward and downward.

* * * * *

UNITED STATES PATENT AND TRADEMARK OFFICE

CERTIFICATE OF CORRECTION

PATENT NO. : 6,233,909 B1
DATED : May 22, 2001
INVENTOR(S) : Onishi

It is certified that error appears in the above-identified patent and that said Letters Patent is hereby corrected as shown below:

Title page,
Item [57] ABSTRACT, after "stations", delete ",";

Column 2,
Line 21, before "case", insert -- third --.

Signed and Sealed this

Nineteenth Day of February, 2002

*Attest:*

*Attesting Officer*

JAMES E. ROGAN
*Director of the United States Patent and Trademark Office*